US005400928A

United States Patent [19]

Resnick

[11] Patent Number: 5,400,928

[45] Date of Patent: Mar. 28, 1995

[54] DRY POCKET NOZZLE RECEPTACLE

[76] Inventor: Todd A. Resnick, 1653 SE. St. Lucie Blvd., Stuart, Fla. 34996-4204

[21] Appl. No.: 195,809

[22] Filed: Feb. 14, 1994

[51] Int. Cl.[6] ..... B67D 3/00

[52] U.S. Cl. ..... 222/530; 222/538; 206/446

[58] Field of Search ..... 206/446; 222/530, 538

[56] References Cited

U.S. PATENT DOCUMENTS

| | | | |
|---|---|---|---|
| 1,276,698 | 8/1918 | Knapp | 222/538 |
| 1,329,184 | 1/1920 | Hyams | 222/538 |
| 1,426,846 | 8/1922 | Craig | 222/538 X |
| 1,713,129 | 5/1929 | Hope | 206/446 |
| 1,855,373 | 4/1932 | Willumsen | 222/538 X |
| 2,163,952 | 6/1939 | Leighton | 222/538 |
| 2,597,593 | 5/1952 | Neuner | 222/530 X |
| 2,673,665 | 3/1954 | Smith | 222/530 |
| 2,684,181 | 7/1954 | Neuner | 222/538 X |
| 4,664,301 | 5/1987 | Hoyt | 222/567 X |
| 4,811,870 | 3/1989 | Bianco | 222/538 X |
| 5,277,343 | 1/1994 | Parsonage | 222/538 X |

FOREIGN PATENT DOCUMENTS

| | | | |
|---|---|---|---|
| 9100226 | 1/1991 | WIPO | 222/538 |

*Primary Examiner*—Andres Kashnikow
*Assistant Examiner*—Kenneth Bomberg
*Attorney, Agent, or Firm*—Brooks & Kushman

[57] ABSTRACT

A container is provided which includes a dry pocket nozzle receptacle for storing a pouring implement such as a nozzle. The nozzle receptacle comprises a generally cylindrical tube for accommodating a nozzle. The tube includes a threaded proximal portion having an aperture for receiving the nozzle, and a cap, which is flexibly attached to the proximal portion of the tube, for sealing the tube so as to prevent environmental exposure to the nozzle and residual container contents. In one embodiment, the nozzle receptacle is an integral part of the container, while another embodiment provides a separate device which may be used with existing containers. Yet another embodiment includes an integral frustoconical portion disposed within the cap and a similar frustoconical portion disposed within the distal end of the tube for sealing the interior of the nozzle when it is situated within the tube during storage.

7 Claims, 4 Drawing Sheets

DRY POCKET NOZZLE RECEPTACLE

TECHNICAL FIELD

The present invention relates to a container having a nozzle receptacle for storing and transporting a nozzle while the nozzle is not in use.

BACKGROUND ART

A wide variety of containers have been developed to store and transport liquids. Typically, the container shape and size is adapted to a particular application to facilitate storage of a convenient quantity of the liquid while also providing means for transferring liquid into, or dispensing liquid from, the container. A flexible nozzle, a spout, a funnel, or similar implement is often used to simplify pouring of the liquid from the storage container. This is especially true when transferring liquid from a relatively large storage container to a comparatively smaller site where the liquid will be used.

The pouring implement may be an integral part of the container such that dispensing liquid from the container does not involve handling of the pouring implement. However, if the pouring implement is permanently attached to the container, the liquid may be exposed to the air during storage such that undesirable vaporization and evaporation occur. Such a container is unacceptable for storage of volatile liquids which may be combustible or flammable, such as petroleum products including mineral spirits, gasoline, kerosene, and the like. Thus, special purpose containers have been developed which include an integral pouring implement while sealing the container to reduce evaporation and vaporization during storage.

A container which incorporates a rotatable pouring spout is disclosed in U.S. Pat. No. 5,277,343 to Parsonage. The spout rotates between a sealing position used for dispensing liquid and a locking position used during storage. Although this container provides an integral pouring implement which also seals the container during storage, it has a relatively complex structure. For example, the container disclosed includes a number of components such as a threaded locking ring, circular plate, and a spring-loaded ball retainer, among others, to solve the problems identified above.

Another container which provides a simpler integrated dispensing spout is disclosed in U.S. Pat. No. 4,811,870 to Bianco. That container has an attached dispensing spout rotatable between stowed and pouring positions. The spout includes a funnel portion which directs and dispenses the liquid through the spout outlet. The funnel portion allows a user to observe the liquid as it is being dispensed to avoid over-filling and spilling of the liquid. Since the funnel portion does not seal the container in its stowed position, a cap is provided to accomplish that function during storage. The cap is preferably attached to the container so it cannot be easily lost or misplaced.

Rather than an integral dispensing device, the pouring implement is more commonly provided as a device which is separate from the container. Of course, the pouring implement must then be attached to the container before being used to facilitate dispensing of liquid. Since this variety of pouring implements is separate from the container, it is susceptible to being lost or misplaced, especially if a long period of time elapses between storage and use of the liquid.

U.S. Pat. No. 2,673,665 to Smith discloses a combination container handle and spout carrier for storing a spout or nozzle when not in use. That invention employs a container handle including a bail having spaced legs with a loop, or eye, in each leg located below the handle to accommodate a nozzle while providing a sufficient space to facilitate carrying the container. A cap is utilized to seal the container for storage.

An accessory which provides similar functionality is disclosed in U.S. Pat. No. 4,664,301 to Hoyt. That invention provides an accessory for releasable attachment to the top rim or bead of a container. The accessory includes two upstanding bracket members each having an appropriately sized aperture which holds the spout when not in use.

These devices have the disadvantage of exposing a nozzle, or other pouring implement, to the atmosphere. Thus, any residual liquid present on the pouring implement is allowed to vaporize or evaporate. When storing volatile, flammable liquids, this may result in a dangerous accumulation of vapors which could lead to an explosion. Also, certain vapors from liquid chemicals have an unpleasant odor and may even pose health risks upon inhalation. In many applications, therefore, it is undesirable to expose a nozzle or other pouring implement to the atmosphere during storage.

Another commonly implemented method of storing a nozzle when not in use includes providing a nozzle which may be inverted and inserted into the spout of the liquid container. Typically, a cap is provided to seal the protruding base of the nozzle during storage of the liquid. This method is often employed for fuel containers, such as gasoline cans, and the like. Although this method provides a relatively simple solution to the problems of nozzle storage and container sealing as discussed above, it is replete with disadvantages, especially when used to store volatile, flammable liquids.

One disadvantage of storing a nozzle or other pouring implement within the liquid container is that the liquid may become contaminated with debris present on the surface of the nozzle. Another disadvantage is the additional handling required to ready the container for dispensing of liquid. Furthermore, the user is exposed to residual liquid present on the interior and exterior of the nozzle. The user must also be careful so that the liquid is not spilled when removing the nozzle, or dripped from the exterior of the nozzle once it is attached to the container for pouring. Note that in dispensing a wide variety of liquids, it is desirable to avoid contact with the liquid. As many users of gasoline are aware, mere incidental contact results in an unpleasant residual odor which is difficult to eradicate. This characteristic is typical of many other petroleum products, such as diesel fuel, in addition to myriad other liquid chemicals.

It is desirable, therefore, to have a container which provides a device for facilitating pouring of liquid while reducing the likelihood of being lost or misplaced.

It is also desirable to have a container which is capable of storing a wide variety of liquids, especially volatile and flammable liquids, while reducing or eliminating the escape of vapors from the container during storage.

It is, furthermore, desirable to have a container which prevents atmospheric exposure of a pouring implement, such as a nozzle, during storage.

It is also desirable to have a container which provides storage for a pouring implement, such as a nozzle, without allowing the pouring implement to contaminate the contents of the container.

It is also desirable to have a container employing a small number of easily manufacturable components which facilitates dispensing of liquid while providing storage for a pouring implement, such as a nozzle.

It is desirable, too, to have a container which reduces potential exposure of the user to the contents of the container while dispensing those contents.

Additionally, it is desirable to have a device which may be utilized with existing containers to store a pouring implement while reducing user exposure to residual container contents present on the implement and minimizing escape of odor, or vapors, from the implement.

DISCLOSURE OF THE INVENTION

It is, therefore, an object of the present invention to provide a container which includes a device for facilitating pouring of liquid while reducing the likelihood of the device being lost or misplaced.

It is also an object of the present invention to provide a container which is capable of storing a wide variety of liquids, especially volatile and flammable liquids, while reducing or eliminating the escape of vapors from the container during storage.

Another object of the present invention is to provide a container which reduces atmospheric exposure of a pouring implement, such as a nozzle, during storage.

A still further object of the present invention is to provide a container which includes storage for a pouring implement, such as a nozzle, without allowing the pouring implement to contaminate the contents of the container.

Yet another object of the present invention is to provide a container which includes a small number of easily manufacturable components for facilitating dispensing of liquid while also providing storage for a pouring implement, such as a nozzle.

A further object of the present invention is to provide a container which reduces potential exposure of the user to the contents of the container when preparing to dispense the contents of the container, as well as during the actual dispensing of those contents.

Another object of the present invention is to provide a device which may be utilized with existing containers to store a pouring implement, while reducing user exposure to residual container contents present about, and within, the implement.

A still further object of the present invention is to provide a device which may be utilized with existing containers to store a pouring implement while minimizing escape of odor or vapors from residual contents present about, and within, the implement.

In carrying out the above object and other objects and features of the present invention, a container is provided which includes a dry pocket nozzle receptacle for storing a pouring implement such as a nozzle. The nozzle receptacle comprises a tube for accommodating a nozzle. The tube includes a threaded proximal portion having an aperture for receiving the nozzle, and a cap, which is flexibly attached to the proximal portion of the tube, for sealing the tube so as to prevent environmental exposure to the nozzle and residual container contents.

In one embodiment of the present invention, the nozzle receptacle is an integral part of the container, while another embodiment provides a separate device which may be used with existing containers. Yet another embodiment provides a separate nozzle receptacle which is stored within a pocket formed in the side of the container. Still another embodiment includes an integral frustoconical protrusion disposed within the cap and a similar frustoconical protrusion disposed within the distal end of the tube for sealing the interior of the nozzle when it is situated within the tube during storage.

The above objects and other objects, features, and advantages of the present invention will be readily appreciated by one of ordinary skill in the art from the following detailed description of the best mode for carrying out the invention when taken in connection with the accompanying drawings.

BEST MODE(S) FOR CARRYING OUT THE INVENTION

Figure 1:
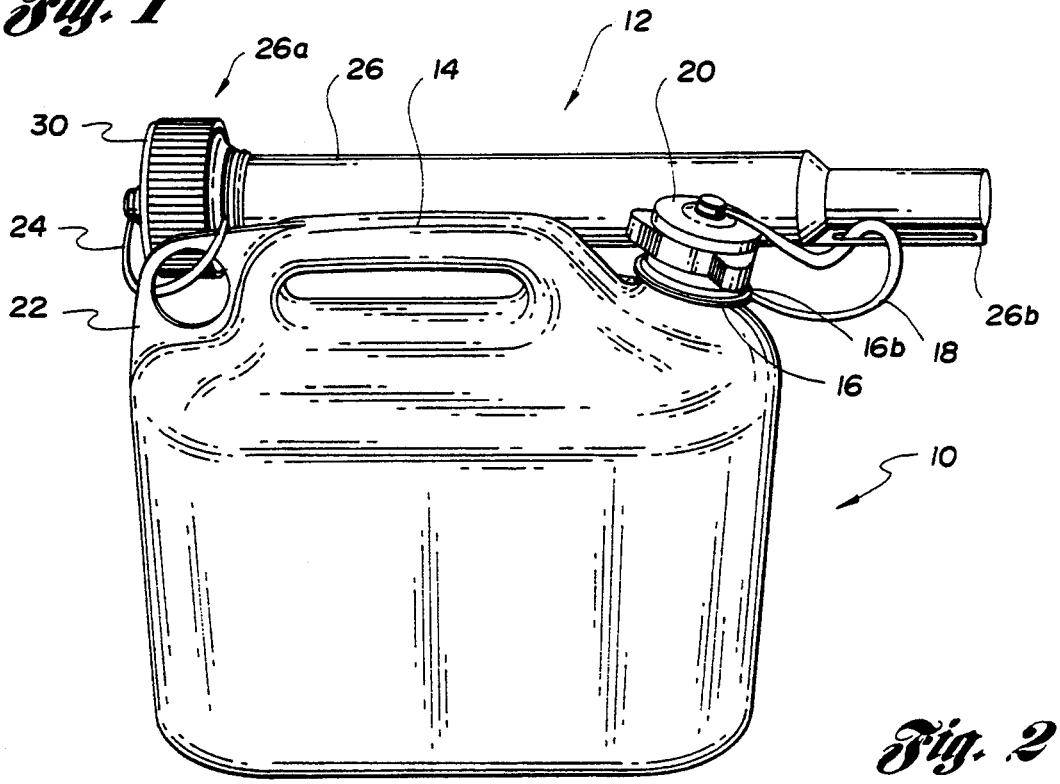
FIG. 1 is a perspective view of a container with an attached dry pocket nozzle receptacle according to the present invention.

Referring now to FIG. 1, a container having an attached dry pocket nozzle receptacle according to the present invention is shown. The container illustrated may be used to store and transport a wide variety of liquids, and is especially suitable for storing and transporting volatile and flammable liquids. Such liquids include a plethora of petroleum products, such as gasoline and diesel fuel, as well as other liquid chemicals.

Preferably, the container is constructed of an impermeable material such as molded plastic. Any of a number of suitable materials, such as HDPE or HDPE II plastic, are commercially available from myriad sources. Of course, the container could also be constructed from a metallic material without departing from the spirit or scope of the present invention. Likewise, the functionality of the present invention does not depend upon the particular shape of the container. Thus, the parallelepiped-shaped container shown in FIG. 1 is used only to illustrate the principles of the present invention.

As shown in FIG. 1, the container includes a liquid containing portion, indicated generally by reference numeral 10, and a dry pocket receptacle 12. Liquid containing portion 10 includes a handle 14 for transporting the container and a spout 16 which is adapted to selectively engage a pouring implement, such as a nozzle. In one embodiment, handle 14 is hollow which allows the contents of the container to flow within the handle. In another embodiment, similar to the embodiment illustrated in FIG. 2, handle 14 is isolated from liquid containing portion 10.

Still referring to FIG. 1, preferably, spout 16 includes a threaded portion 16*a* (not specifically illustrated) for selective engagement with a complementarily threaded pouring implement while dispensing the contents of the container. Also preferably, spout 16 includes a lip 16*b*, located below threaded portion 16*a*, which may be used to secure a first fastening means 18 to liquid containing portion 10. A cap 20 having a suitable seal, such as an O-ring (not specifically illustrated), is utilized to threadingly engage threaded portion 16*a* of spout 16 so as to seal liquid containing portion 10 during storage of the container. Preferably, first fastening means 18 is rotatably secured near the center of cap 20 to facilitate installation and removal of cap 20 on liquid containing portion 10.

With continuing reference to FIG. 1, liquid containing portion 10 also includes attaching means 22 which may be used in attaching dry pocket receptacle 12 to liquid containing portion 10 via a second fastening means 24. First and second fastening means 18, 24 may include a plastic tether strap, a chain, or the like. Dry pocket receptacle 12 includes a generally cylindrical tube 26 for accommodating a pouring implement, such as a nozzle 28 (best illustrated in FIG. 2). Of course tube 26 could have any of a number of cross-sectional geometries, such as a circle, square, ellipse, or other shape suitable for accommodating a pouring implement. Tube 26 includes a threaded proximal portion 26*a* having an aperture for receiving nozzle 28. Threaded proximal portion 26*a* engages a complementarily threaded receptacle cap 30. Tube 26 also includes a tethering loop 26*b* near its distal end to secure dry pocket receptacle 12 to liquid containing portion 10.

Still referring to FIG. 1, preferably, receptacle cap 30 includes an appropriate seal, such as an O-ring (not specifically illustrated) for sealing the tube so as to prevent environmental exposure of nozzle 28 and residual container contents situated within tube 26. Also preferably, second fastening means 24 is rotatably secured near the center of receptacle cap 30, while also being secured to tube 26 near threaded proximal portion 26*a*. In addition, second fastening means 24 is preferably coupled to liquid containing portion 10 via attaching means 22.

In operation, to dispense stored liquid from the container, cap 20 is removed from threaded portion 16*a* of spout 16. Note that cap 20 is retained near the container by first fastening means 18. Receptacle cap 30 is removed from threaded proximal portion 26*a* of tube 26 and is retained near the container by second fastening means 24. Nozzle 28 is removed from tube 26 and installed on threaded portion 16*a* of spout 16. After dispensing liquid from the container, nozzle 28 is removed from threaded portion 16*a* of spout 16 and returned to tube 26 of dry pocket receptacle 12. Receptacle cap 30 is then utilized to seal nozzle 28 and any residual liquid within tube 26. Cap 20 is then replaced to seal remaining liquid within liquid containing portion 10 of the container. Nozzle 28 is now isolated from the environment to reduce escape of vapors, fumes, and the like. Furthermore, nozzle 28 is conveniently stored with the container in a dry pocket so as to solve the problems associated with prior art containers.

Figure 2:
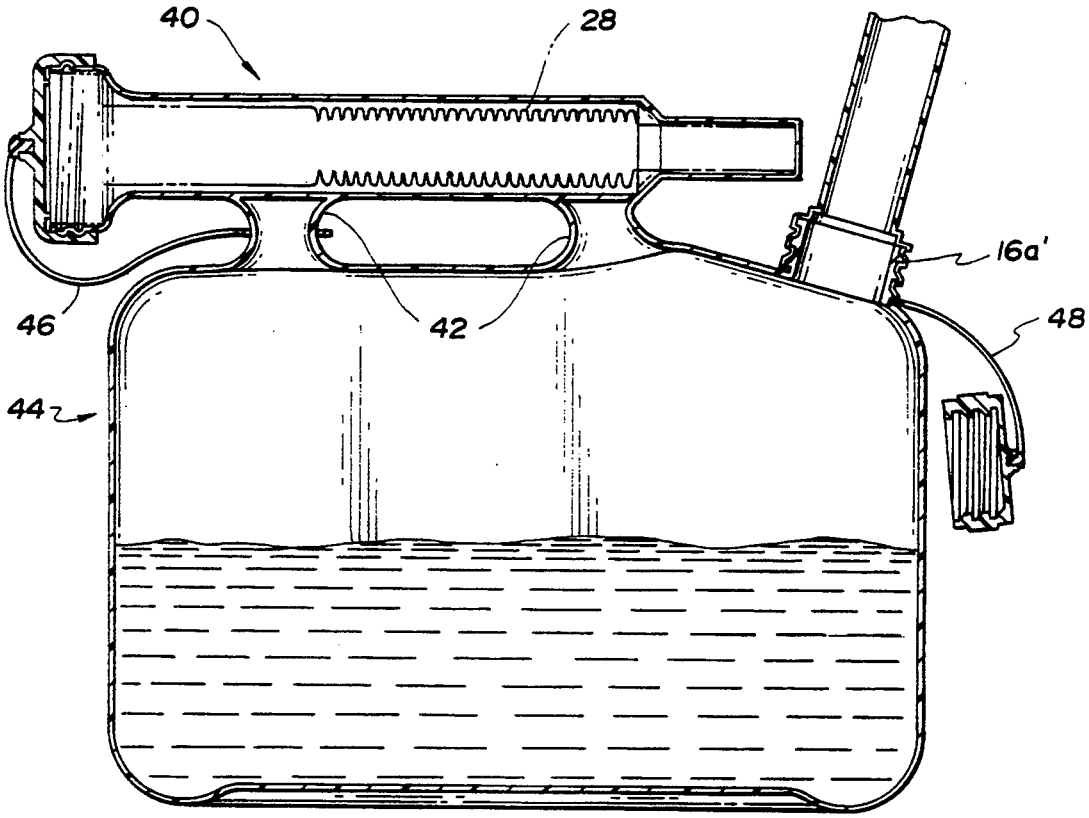
FIG. 2 is a cross-sectional view of one embodiment of the present invention which includes a container having an integral dry pocket nozzle receptacle which is external to the container.

Referring now to FIG. 2, a cross-sectional view of one embodiment of the present invention is shown. This embodiment includes a container having an integral dry pocket nozzle receptacle 40 which is external to the container contents. Separation means 42 isolate the interior of nozzle receptacle 40 from fluid containing portion 44 of the container. Nozzle receptacle 40 is spaced an appropriate distance from fluid containing portion 44, and is of a suitable construction such that nozzle receptacle 40 also functions as a handle for carrying the container.

Separation means 42 also provide convenient sites for attaching first and second cap retainers 46 and 48, respectively, to fluid containing portion 44. As shown in FIG. 2, second cap retainer 48 may be attached below threaded portion 16*a*′ similar to the embodiment illustrated in FIG. 1. Likewise, first cap retainer 46 may alternatively be attached to receptacle 40 near its threaded proximal end, rather than to separation means 42. Note that in this embodiment, nozzle receptacle 40, separation means 42, and fluid containing portion 44 form a single integrated unit.

As also shown in FIG. 2, the container includes other components which are similar in structure and function to those components illustrated in the embodiment of FIG. 1, and described in detail above.

Figure 3:
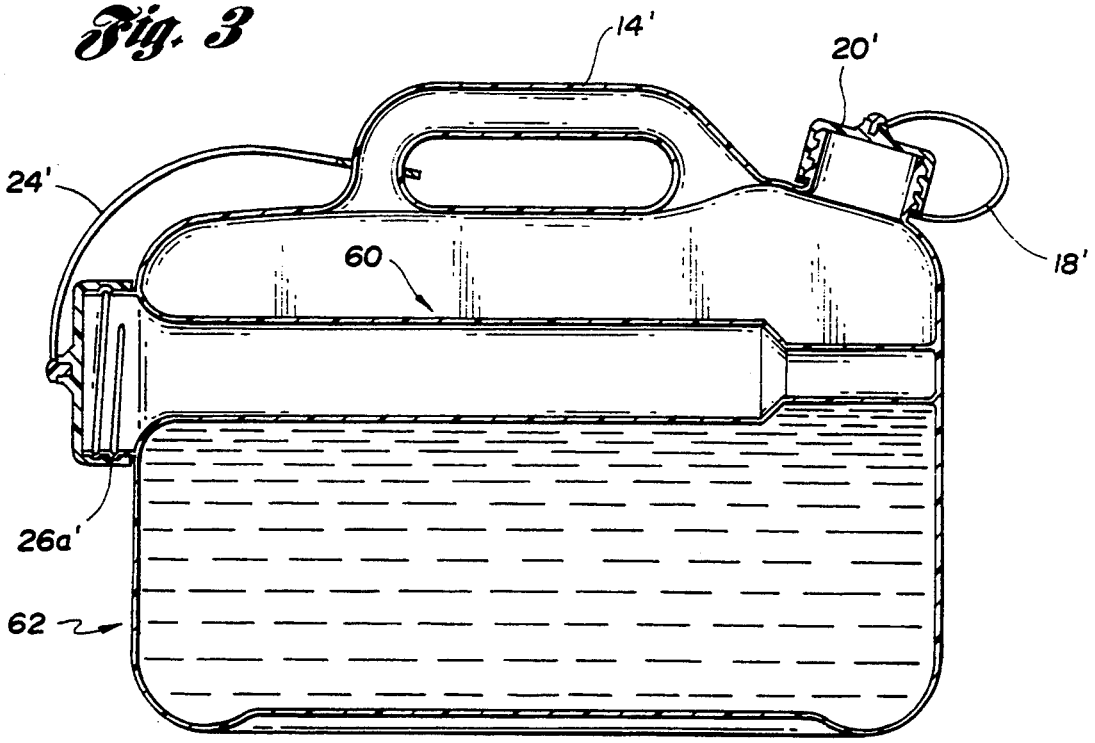
FIG. 3 is a cross-sectional view of an integral dry pocket nozzle receptacle disposed within the container according to the present invention.

Referring now to FIG. 3, a cross-sectional view of another embodiment of the present invention is shown. This embodiment includes an integral dry pocket nozzle receptacle 60 disposed within liquid containing portion 62. Preferably, nozzle receptacle 60 extends through liquid containing portion 62 to provide additional structural support. Therefore, receptacle 60 is surrounded by the container contents. Again, this embodiment includes a number of other components similar in structure and function to those embodiments illustrated in FIGS. 1 and 2. The above detailed description of those similar components is, therefore, incorporated by reference here.

Figure 4:
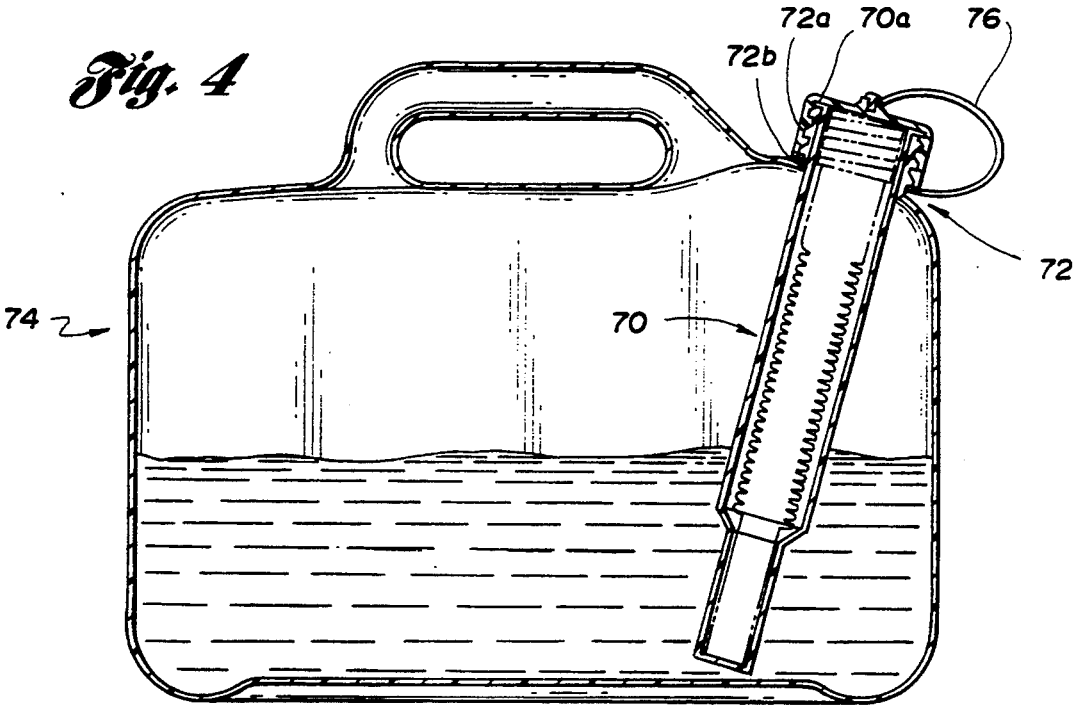
FIG. 4 is a cross-sectional view of a container having a separate dry pocket nozzle receptacle stored within the spout of the container according to the present invention.

Referring now to FIG. 4, a cross sectional view of another embodiment of the present invention is shown. The container includes a separate dry pocket receptacle 70 stored within the spout 72 of the liquid containing portion 74 of the container. As before, spout 72 includes a threaded portion 72*a* and a lip 72*b* which may be used in securing cap retainer 76 to liquid containing portion 74. Preferably, cap retainer 76 is rotatably secured near the center of cap 78. In this embodiment, cap 78 seals liquid containing portion 74 as well as dry pocket receptacle 70. Thus a pouring implement, such as nozzle 80, is stored within dry pocket receptacle 70 where it is protected from the contents of the container.

Still referring to FIG. 4, dry pocket receptacle 70 includes a flange 70*a* to prevent receptacle 70 from passing entirely through the opening of spout 72. In operation, to dispense the contents of the container, cap 78 is removed from threaded portion 72*a* of spout 72 and is retained near the container by cap retainer 76. Dry pocket receptacle 70 (which contains nozzle 80) is removed from spout 72. Nozzle 80 is then removed from dry pocket receptacle 70 and installed on threaded portion 72*a* of spout 72 to allow dispensing of the container contents.

Still referring to FIG. 4, after dispensing, nozzle 80 is removed from threaded portion 72*a* of spout 72 and inserted into dry pocket receptacle 70 which is then inserted into spout 72. Cap 78 is replaced on threaded portion 72*a* of spout 72 so as to seal dry pocket receptacle 70, as well as liquid containing portion 74 of the container, for storage.

Figure 5:
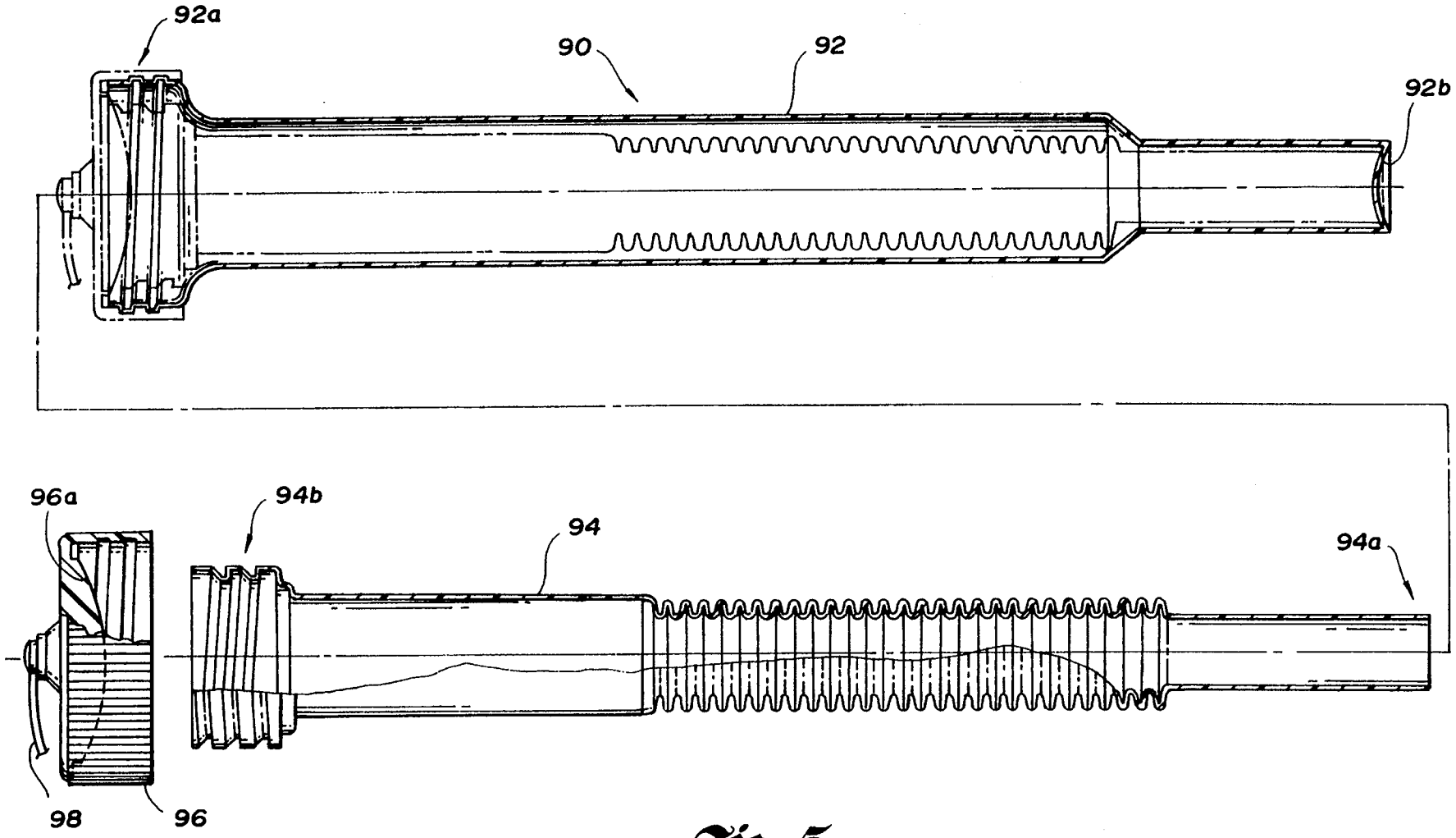
FIG. 5 illustrates the frustoconical protrusions utilized to seal the interior of a nozzle situated within a dry pocket nozzle receptacle according to the present invention.

Referring now to FIG. 5, another embodiment of the present invention is illustrated having frustoconical protrusions to seal the interior of a nozzle situated within a dry pocket nozzle receptacle. This feature may be incorporated into any of the embodiments previously described. Dry pocket nozzle receptacle 90 includes tube 92 having an aperture at its proximal end. Threaded portion 92*a* is also located near the proximal end of tube 92.

As also shown in FIG. 5, the distal end of tube 92 includes a protrusion 92*b*. Protrusion 92*b* may be dome-shaped, frustoconical, or other similar shape which functions as a pilot to locate nozzle 94 within tube 92 while also acting as a wedge to seal the distal end 94*a* of nozzle 94. Similarly, cap 96 includes a protrusion 96*a* which functions as a pilot to locate the proximal end 94*b* of nozzle 94 within tube 92. Protrusion 96*a* also acts as a wedge to seal the proximal end 94*b* of nozzle 94. Preferably, cap retainer 98 is rotatably secured near the center of cap 96 while also being coupled to tube 92. Thus, once cap 96 is secured to threaded portion 92*a* of tube 92, nozzle 94 is wedged and sealed between protrusions 92*b* and 96*a*.

Figure 6:
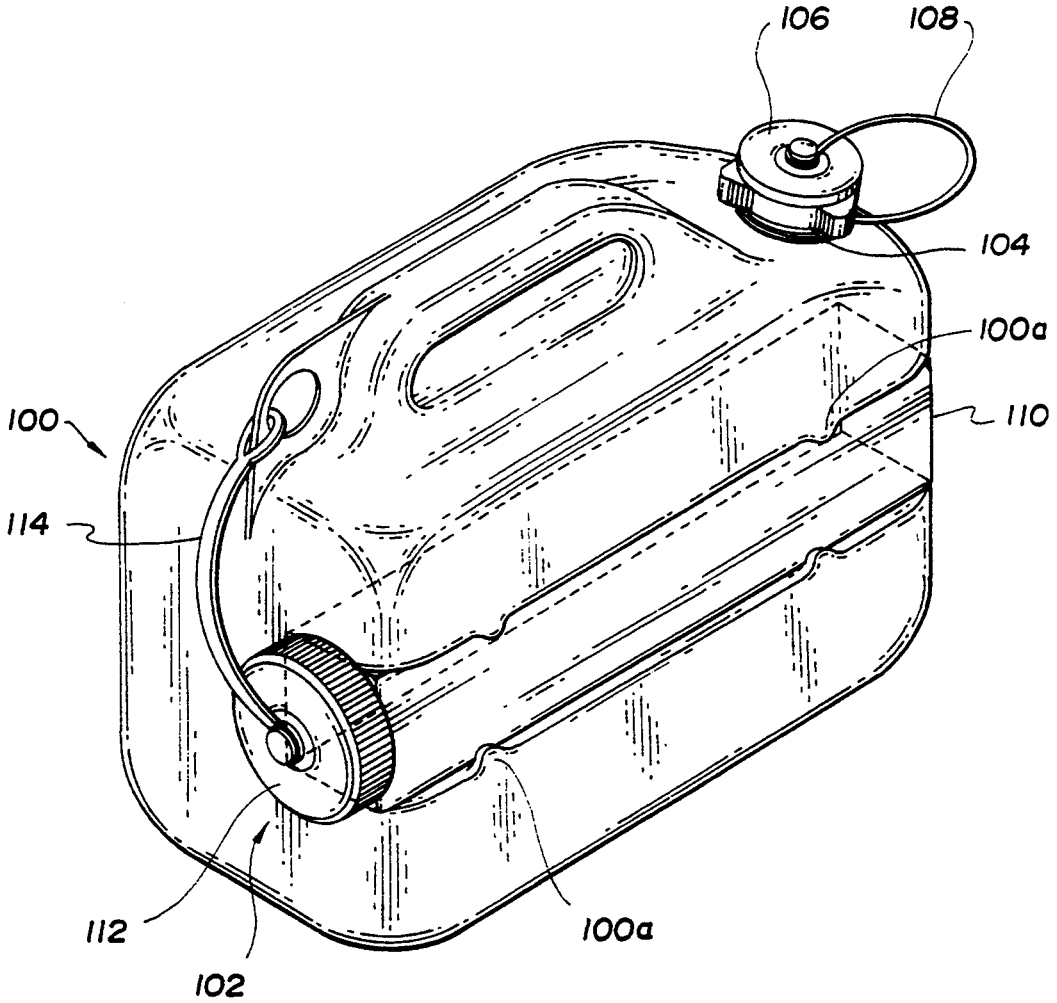
FIG. 6 is a cross-sectional view of a container having a separate dry pocket nozzle receptacle stored within a pocket formed in the container.

FIG. 6 illustrates another embodiment of the present invention having a separate dry pocket receptacle. Similar to the embodiments already described and illustrated, this embodiment includes a liquid containing portion 100 and a dry pocket receptacle 102. Liquid containing portion 100 includes a spout 104 having a threaded portion for selectively engaging a first cap 106. A cap retainer 108 is rotatably secured near the center of cap 106 and is also secured to spout 104 below the threaded portion.

As also illustrated in FIG. 6, liquid containing portion 100 includes a concave portion extending along liquid containing portion 100 for receiving tube 110 of dry pocket receptacle 102 during storage. Liquid containing portion 100 also includes at least one protrusion 100*a* located near the outer edge of the concave portion for securely retaining tube 110 within the concave portion during storage.

Dry pocket receptacle 102 also includes a second cap 112 and a second cap retainer 114. Preferably second cap retainer 114 is rotatably secured near the center of second cap 112 and also secured to liquid containing portion 100. Also preferably, second cap 112 threadingly engages tube 110. Tube 110 may have a rectangular cross section so as to hinder rotation when second cap 112 is turned. Of course, other cross-sectional geometries which hinder rotation would work as well.

The concave portion of liquid containing portion 100 may be formed such that second cap 112 is recessed and substantially flush with the container end (along a longitudinal tube axis) while protruding somewhat from the side of the container (radially relative to the second cap) to facilitate turning of the second cap. Alternatively, second cap 112 may extend fully or partially beyond the end of the container to permit complete access to second cap 112. This embodiment permits a pouring implement stored within tube 110 to be removed and replaced without removing tube 110 from the concave portion of liquid containing portion 100.

It is understood, of course, that while the form of the invention herein shown and described includes the best mode for carrying out the invention, it is not intended to illustrate all possible forms thereof. It will also be understood that the words used are descriptive rather than limiting, and that various changes may be made without departing from the spirit and scope of the invention disclosed.

What is claimed is:

1. A container for storing, transporting, and dispensing a liquid, the container having a spout adapted to receive a pouring implement for dispensing the liquid, the pouring implement having proximal and distal ends, the container also having a first cap adapted to engage and seal the spout during storage and transportation of the liquid, a handle for transporting the liquid, and a receptacle for storing the pouring implement, the receptacle comprising:

a tube having an open proximal end for receiving the pouring implement during storage of the pouring implement and a closed distal end having a loop;

a second cap adapted to engage and seal the open proximal end of the tube so as to prevent atmospheric exposure of the pouring implement during storage;

first fastening means secured to the first cap and secured to the spout for retaining the first cap within close proximity of the container; and second fastening means secured to the second cap and secured to the open proximal end for retaining the second cap within close proximity of the tube, wherein the first fastening means passes through the loop so as to flexibly couple the tube to the first cap and the spout.

2. A container for storing, transporting, and dispensing a liquid, the container having a liquid containing portion with a spout adapted to receive a pouring implement for dispensing the liquid, the pouring implement having proximal and distal ends, the container also having a first cap adapted to engage and seal the spout during storage and transportation or the liquid, a handle for transporting the liquid, and a receptacle for storing the pouring implement, the receptacle comprising:

a tube having an open proximal end for receiving the pouring implement during storage of the pouring implement and a closed distal end:

a second cap adapted to engage and seal the open proximal end of the tube so as to prevent atmospheric exposure of the pouring implement during storage;

first fastening means secured to the first cap and secured to the spout for retaining the first cap within close proximity of the container; and second fastening means secured to the second cap and secured to the open proximal end for retaining the second cap within close proximity of the tube, wherein the second fastening means is operative to flexibly couple the proximal end of the tube to the liquid containing portion.

3. The container of claim 1 wherein the second cap includes a protrusion operative to locate the proximal end of the pouring implement within the tube while sealing the proximal end of the pouring implement when the second cap is secured to the tube.

4. The container of claim 1 wherein the distal end of the tube includes a protrusion operative to locate the distal end of the pouring implement within the tube while sealing the distal end of the pouring implement when the second cap is secured to the tube.

5. The container of claim 3 wherein the protrusion is frustoconical in shape.

6. The container of claim 1 wherein the pouring implement is a flexible nozzle and wherein the proximal end of the pouring implement is threaded to rotatably engage the spout.

7. The container of claim 1 wherein the first and second fastening means are rotatably secured to the first and second caps, respectively.

* * * * *